US008382276B2

(12) United States Patent
Ikeda

(10) Patent No.: US 8,382,276 B2
(45) Date of Patent: Feb. 26, 2013

(54) INKJET RECORDING APPARATUS

(75) Inventor: Masami Ikeda, Osaka (JP)

(73) Assignee: Kyocera Mita Corporation (JP)

( * ) Notice: Subject to any disclaimer, the term of this patent is extended or adjusted under 35 U.S.C. 154(b) by 135 days.

(21) Appl. No.: 12/951,408

(22) Filed: Nov. 22, 2010

(65) Prior Publication Data

US 2011/0122211 A1 May 26, 2011

(30) Foreign Application Priority Data

Nov. 26, 2009 (JP) ..... 2009-268210

(51) Int. Cl.
*B41J 2/01* (2006.01)

(52) U.S. Cl. ..... 347/104; 347/101

(58) Field of Classification Search ..... None
See application file for complete search history.

(56) References Cited

U.S. PATENT DOCUMENTS

| | | | | |
|---|---|---|---|---|
| 4,831,419 | A * | 5/1989 | Iaia et al. | 355/76 |
| 5,712,672 | A * | 1/1998 | Gooray et al. | 347/102 |
| 6,179,285 | B1 * | 1/2001 | Teumer et al. | 271/194 |
| 6,209,867 | B1 * | 4/2001 | Madsen et al. | 271/276 |
| 6,394,596 | B1 * | 5/2002 | Wotton et al. | 347/104 |
| 6,729,720 | B2 * | 5/2004 | Miki et al. | 347/104 |
| 7,497,567 | B2 * | 3/2009 | Kumagai | 347/104 |
| 7,950,757 | B2 * | 5/2011 | Kumagai | 347/8 |
| 2005/0095046 | A1 * | 5/2005 | Beehler | 400/23 |
| 2006/0043666 | A1 * | 3/2006 | Piccinino, Jr. | 271/276 |
| 2008/0213027 | A1 * | 9/2008 | Yraceburu et al. | 400/648 |
| 2009/0251522 | A1 * | 10/2009 | Koike | 347/104 |
| 2010/0084803 | A1 * | 4/2010 | Akihiro et al. | 271/3.22 |
| 2010/0276879 | A1 * | 11/2010 | Bober | 271/276 |

FOREIGN PATENT DOCUMENTS

| | | |
|---|---|---|
| JP | 2005170547 | 6/2005 |
| JP | 2007-31007 | 2/2007 |
| JP | 2009249060 A * | 10/2009 |

* cited by examiner

*Primary Examiner* — Stephen Meier
*Assistant Examiner* — Leonard S Liang
(74) *Attorney, Agent, or Firm* — Gerald E. Hespos; Michael J. Porco; Matthew T. Hespos

(57) ABSTRACT

A conveying platen is provided with a plurality of air circulation parts, each of which includes a long groove opened toward the conveying belt and formed in a longitudinal direction following a conveying direction, and a hole that penetrates in a thickness direction from a part of a bottom surface of the long groove. These air circulation parts are arrayed in the conveying direction and a width direction perpendicular to the conveying direction. The conveying platen has an opposed region which faces a nozzle surface. The long groove is provided in the opposed region. The hole is provided in a region other than the opposed region.

14 Claims, 8 Drawing Sheets

INKJET RECORDING APPARATUS

BACKGROUND OF THE INVENTION

1. Field of the Invention

The present invention relates to an inkjet recording apparatus.

2. Description of the Related Art

As an inkjet recording apparatus that has a conveyance mechanism for conveying a recording medium such as a sheet of paper, the following inkjet recording apparatus is known. Examples of the conveyance mechanism include the one that has a conveying belt with a plurality of through-holes and having a sheet mounted on a front surface thereof, a conveying plate that is oppositely disposed along a lower surface of the conveying belt and provided with a plurality of air circulation holes on nearly the entire conveying plate, and negative pressure generating means disposed below the conveying plate and for suctioning the sheet through the air circulation holes of the conveying plate and the through-holes of the conveying belt. In an inkjet, a nozzle surface provided with a plurality of nozzles is disposed opposite to the front surface of the conveying belt.

In such a conveyance mechanism, not to mention it is important to stably suction air from all of the plurality of air circulation holes provided on the conveying plate in order to stably convey the sheet by means of the conveying belt. Particularly, the flow of the air in the vicinity of the inkjet head is important because it has a great impact on image formation.

In a conventional inkjet recording apparatus, there is known a conveyance mechanism that has air flow control means for performing control to reduce the amount of air at a predetermined region that extends from immediately below an inkjet head to a downstream side in a sheet conveying direction. This conveyance mechanism closes air circulation holes in a section corresponding to the predetermined region on a conveying platen, reduces the density of the air circulation holes formed in the section corresponding to the predetermined region, and reduces the diameter of each of the air circulation holes in the section corresponding to the predetermined region. Consequently, the amount of air decreases in the predetermined region, which, in turn, supposedly can prevent contamination of the sheet that is caused by ink mist generated at a front edge of the sheet.

Incidentally, in this conventional conveyance mechanism, the plurality of air circulation holes provided on the conveying platen are in a circular form. Therefore, many of the air circulation holes need to be arrayed over the entire conveying platen so that the sheet can be suctioned by substantially the entire conveying platen. With such many air circulation holes, the relative position between the sheet and the conveying platen changes during conveyance of the sheet, and consequently the suction power to suction the sheet fluctuates easily. In other words, if the degree in which the conveying platen and the sheet overlap in a thickness direction changes due to the change of the relative position, the rate of the air circulation holes closed (covered) by the sheet changes. A large negative pressure is obtained when the rate of the air circulation holes closed by the sheet increases, hence the suction power increases. When, on the other hand, the rate of the air circulation holes closed by the sheet is small, such as when the sheet is positioned on an upstream side or downstream side of the inkjet head, the suction power to suction the sheet is not sufficient. Specifically, in the latter situation, there are a number of unclosed air circulation holes from which a large amount of air is suctioned, and as a result a sufficient negative pressure for suctioning the recording medium cannot be obtained.

In addition, when the suction power to suction the sheet is not sufficient in a region facing the nozzle surface of the inkjet head, the front edge or rear edge of the sheet floats away from the conveying belt and abuts on the inkjet head.

On the other hand, large suction power of the air in the region facing the nozzle surface of the inkjet head promotes ink to be dried and become viscous at a plurality of nozzles provided on the nozzle surface of the inkjet head.

SUMMARY OF THE INVENTION

An object of the present invention is to provide an inkjet recording apparatus, which is capable of preventing fluctuation of the suction power for suctioning a recording medium, and preventing the recording medium from floating in a region facing a nozzle surface of an inkjet head.

An inkjet recording apparatus according to the present invention includes a conveying belt, inkjet head, conveying platen, and negative pressure generating part. The conveying belt has a plurality of through-holes, and conveys a recording medium in a conveying direction with the recording medium placed on a front surface thereof. The inkjet head has a nozzle surface provided with a plurality of nozzles, and the nozzle surface is disposed opposite to the front surface of the conveying belt. The conveying platen is a plate-like member that is disposed opposite to a rear surface of the conveying belt. This conveying platen is provided with a plurality of air circulation parts, each of which includes a long groove, which is opened toward the conveying belt and formed in a longitudinal direction following the conveying direction, and a hole that penetrates in a thickness direction from a part of a bottom surface of the long groove. These air circulation parts are arrayed in the conveying direction and a width direction perpendicular thereto. The conveying platen has an opposed region which faces the nozzle surface, the long groove is provided in the opposed region, and the hole is provided in a region other than the opposed region.

DETAILED DESCRIPTION OF THE PREFERRED EMBODIMENTS

The inkjet recording apparatus according to an embodiment of the present invention is described hereinafter in detail with reference to the drawings.

Figure 1:
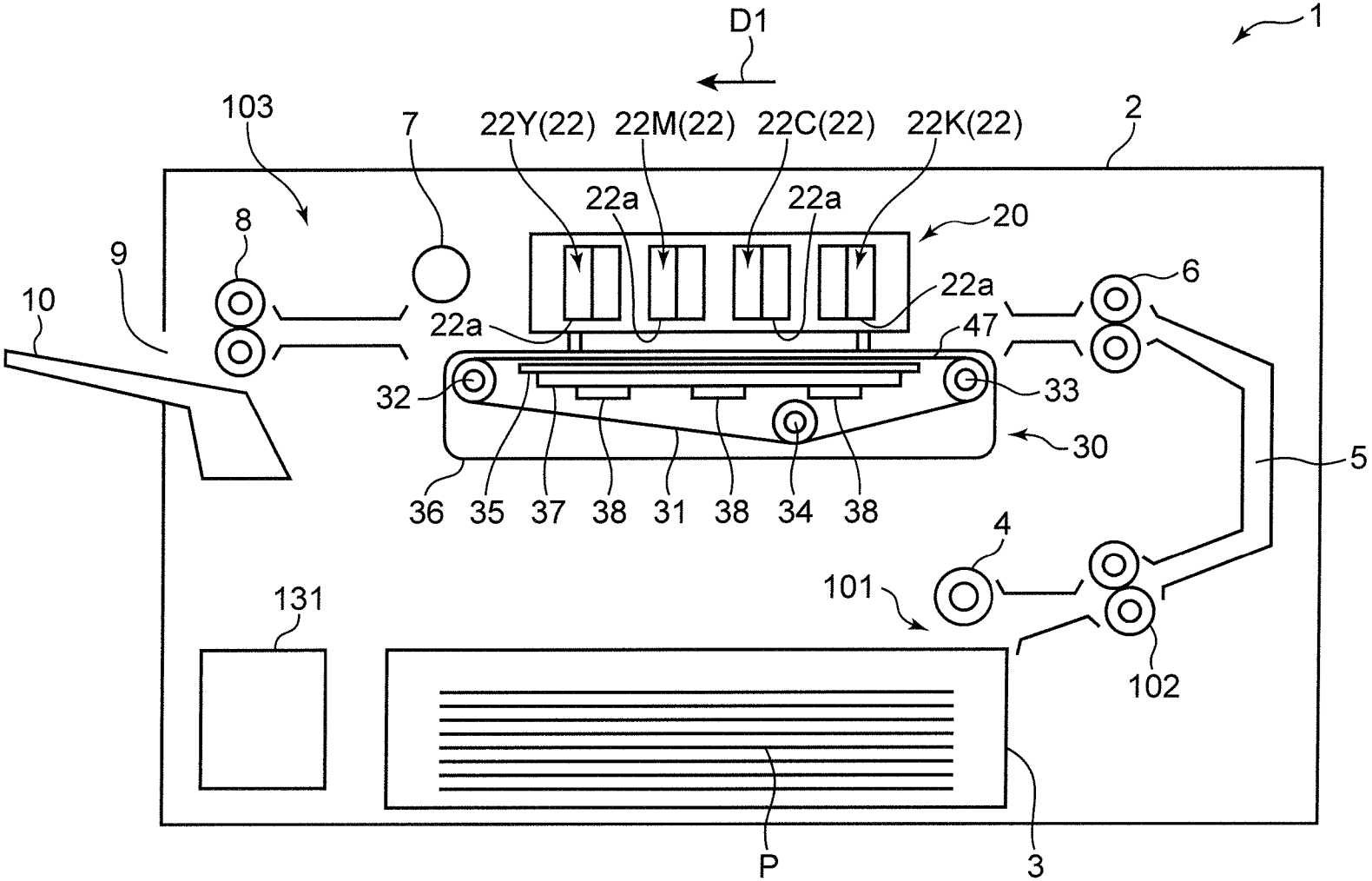
FIG. 1 is a configuration diagram schematically showing an inkjet recording apparatus according to an embodiment of the present invention.

An inkjet recording apparatus 1 shown in FIG. 1 is an inkjet printer that is capable of forming an image on a recording medium, e.g., a sheet P, on the basis of image information received from an external computer. This recording apparatus 1 has, within a casing 2 thereof, a recording part 20, sheet storing part 101, sheet conveying path 5, conveyance unit 30, delivery part 103, and controller 131 controlling these elements. It should be noted in the following description that a conveying direction in which the sheet P is conveyed on the conveyance unit 30 is referred to as "direction D1" and a direction perpendicular thereto (a width direction of the sheet P) as "direction D2."

Figure 2:
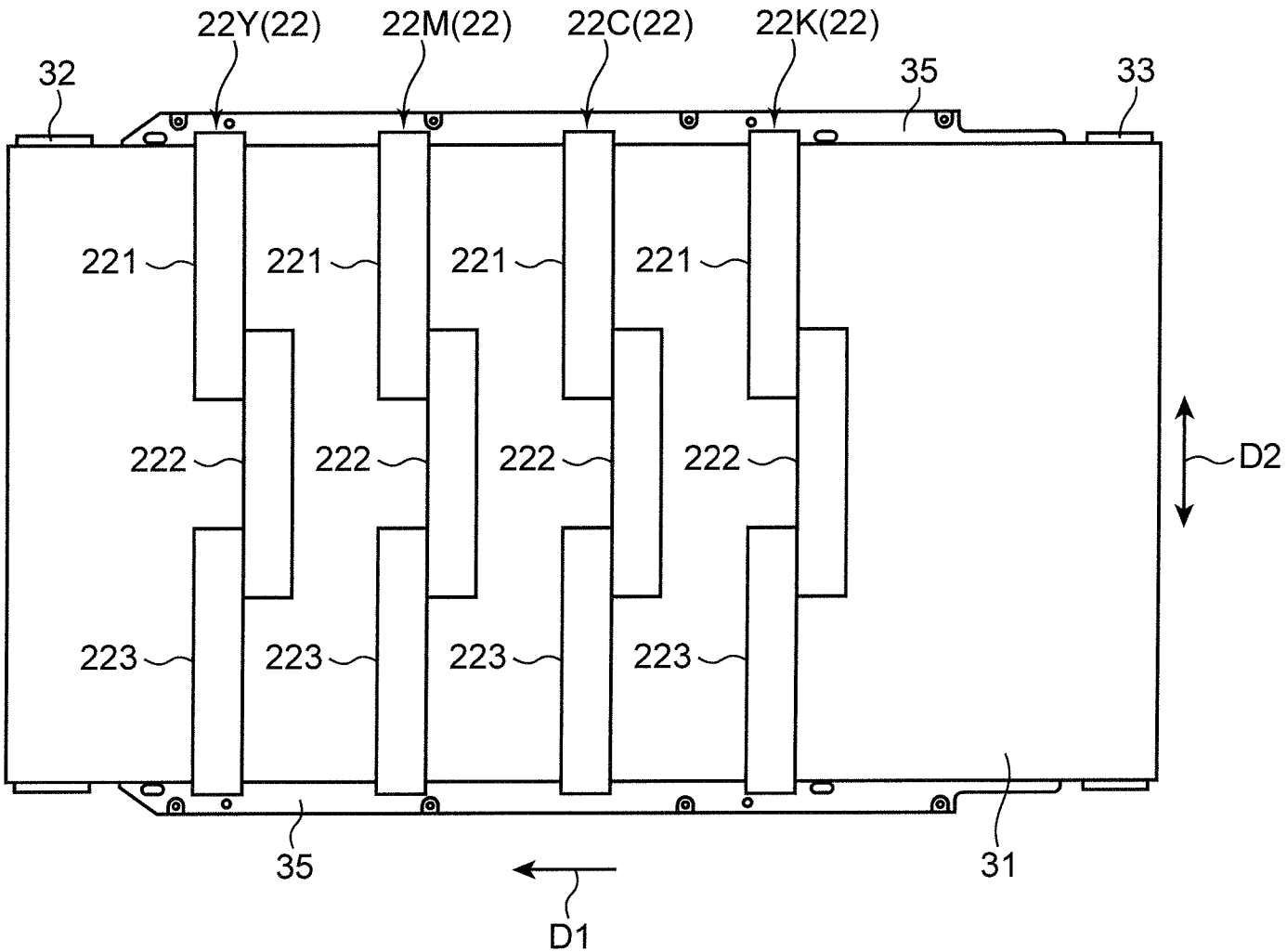
FIG. 2 is a plan view showing the positional relationship among inkjet heads, a conveying belt and a conveying platen of the inkjet recording apparatus.

The recording part 20 has four groups of inkjet heads 22 (22K, 22C, 22M and 22Y) corresponding to colors black, cyan, magenta and yellow, sequentially, from an upstream side of the direction D1, as shown in FIG. 1. As shown in FIG. 2, each of the groups of inkjet heads 22 is configured by three inkjet heads 221 to 223, which are disposed such that the longitudinal direction thereof extends along the direction D2 and such that end parts thereof overlap with one another in the direction D1. The twelve inkjet heads 22 are arranged above a conveying belt 31 of the conveying unit 30, which is described hereinafter. Each of the inkjet heads 22 is supported by a head supporting member (not shown). The inkjet recording apparatus 1 is provided with four ink tanks, not shown, that correspond to the inkjet heads 22 of these colors. The ink of these colors is replenished from the relevant ink tanks to the corresponding inkjet heads 22. It should be noted in the following description that the identification symbols "K," "C," "M" and "Y" are omitted unless otherwise specified.

Each of the inkjet heads 22 has a nozzle surface 22*a* on its lower surface, as shown in FIG. 1. The nozzle surface 22*a* is in a rectangular form extending along a direction perpendicular to the conveying direction of the sheet P. The nozzle surface 22*a* is provided with a plurality of nozzles for ejecting the ink. Each of the inkjet heads 22 is a line-type head that is capable of forming an image by ejecting the ink from the nozzles of the nozzle surface 22*a* in a direction substantially perpendicular to a sheet surface of the sheet P.

As an ink ejection system of the inkjet heads 22, various types of systems can be adopted, such as a piezo system that extrudes the ink using piezo elements, and a thermal inkjet system that generates air bubbles using a heat generator and then applies pressure to eject the ink.

The sheet storing part 101 capable of storing the sheet P is disposed below the conveyance unit 30. The sheet storing part 101 has a sheet feeding cassette 3 storing sheets, and a sheet feeding roller 4 for feeding the sheets to the sheet conveying path 5.

The sheet conveying path 5 has rollers 102 that configure a section on the upstream side of the sheet conveying path 5, and resist rollers 6 that stop each of the sheets for a while, to correct the inclination thereof, and then sends the sheet to the conveyance unit 30.

The conveyance unit 30 is disposed below the recording part 20. This conveyance unit 30 feeds the sheet P to the recording part 20, and conveys, to the delivery part 103, the sheet P on which the image is formed by the recording part 20. The conveyance part 30 is described hereinafter in more detail.

The delivery part 103 has a drying device 7, delivery rollers 8, a delivery port 9 and delivery tray 10. The drying device 7 is disposed on the downstream side of the direction D1 from the conveyance unit 30. The ink that is ejected to the sheet P in the recording part 20 is dried by the drying device 7. The sheet P with the dried ink thereon is sent to the delivery port 9 by the delivery rollers 8, and then delivered to the delivery tray 10 that extends to the outside from a side surface of the casing 2.

The controller 131 is constituted by a central processing unit (CPU), a memory (ROM) in which programs and other data are stored, and a memory (RAM) for temporarily storing the data upon execution of the programs.

The operations of the recording apparatus 1 are described simply as follows. First of all, when a command for forming an image is issued by a computer connected to the outside, a sheet is sent from the sheet storing part 101 to the conveyance unit 30. When the sheet is conveyed by the conveying belt 31 of the conveyance unit 30, the ink is ejected from the inkjet heads 22, whereby the image is formed on the sheet. The sheet having the image formed thereon is conveyed by the rollers 8 of the delivery part 103 and delivered from the delivery port 9 to the delivery tray 10.

This is the entire configuration of the recording apparatus 1. The conveyance unit 30 is now described in detail.

As shown in FIG. 1, the conveyance unit 30 has a frame 36, rollers 32, 33 and 34, the conveying belt 31, a conveying platen 35, fan case 37, and three fans 38. The rollers 32, 33 and 34 are spaced apart from one another by a predetermined distance and supported by the frame 36 so as to rotate freely in the direction D1. As will be described hereinafter, the fan case 37 and each of the fans 38 function as negative pressure generating parts.

Figure 3:
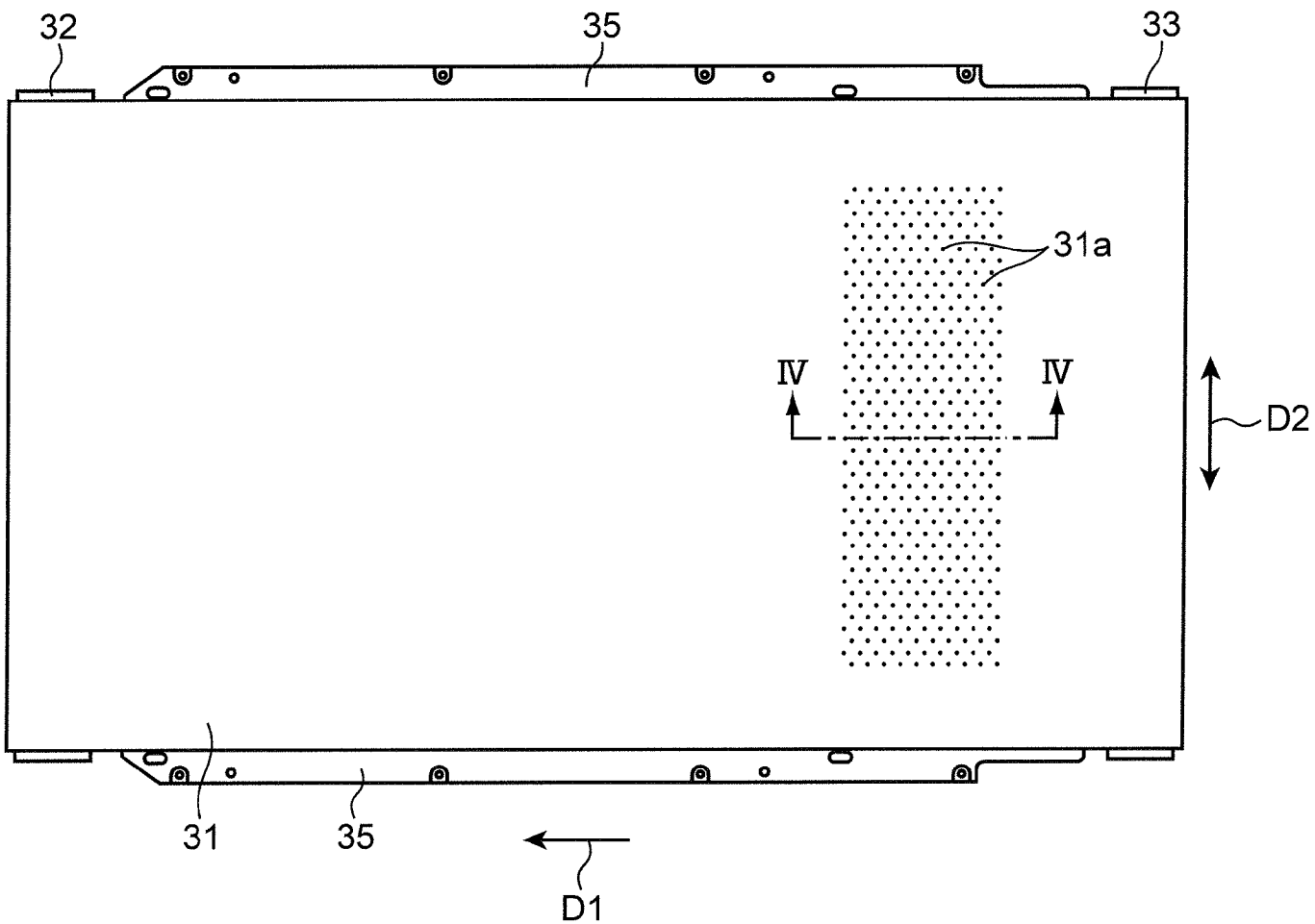
FIG. 3 is a plan view showing the conveying belt and conveying platen of the inkjet recording apparatus.
Figure 4:
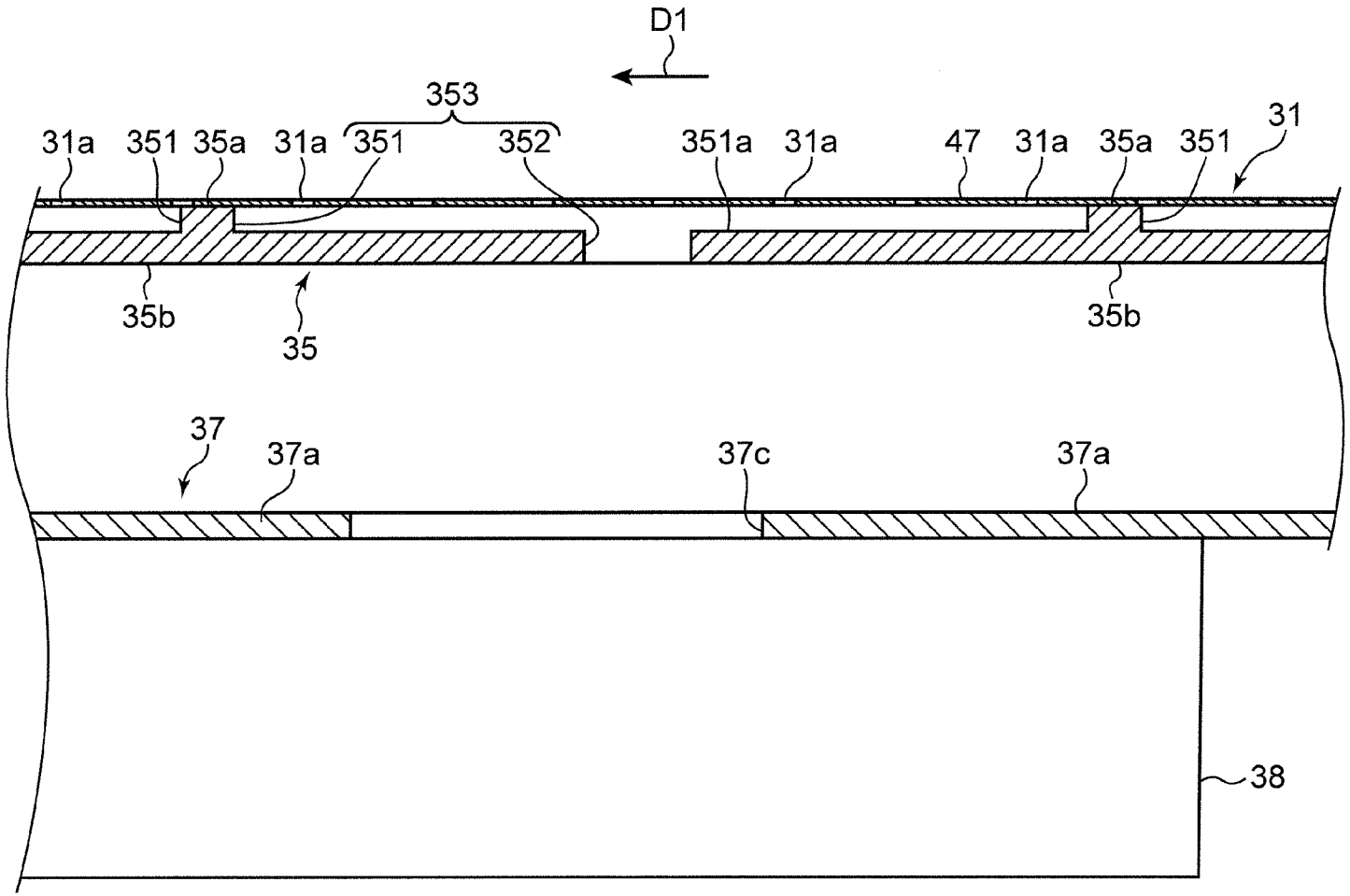
FIG. 4 is a cross-sectional diagram taken along the line IV-IV shown in FIG. 3.

As shown in FIGS. 1 to 3, the conveying belt 31 is an endless belt wrapped around the rollers 32, 33 and 34. A front surface (an upper surface) of the conveying belt 31 between the roller 33 and the roller 32 functions as a conveying surface 47 (mount surface 47) for conveying the sheet P. This conveying surface 47 faces the nozzle surfaces 22*a* of the plurality of the inkjet heads 22. As shown in FIGS. 3 and 4, a plurality of through-holes 31*a* are arrayed at a predetermined interval, substantially over the entire area of the conveying belt 31. Note that FIG. 3 shows the through-holes 31*a* only in a part of the conveying belt 31 and hides the rest of the through-holes 31*a*.

Figure 5:
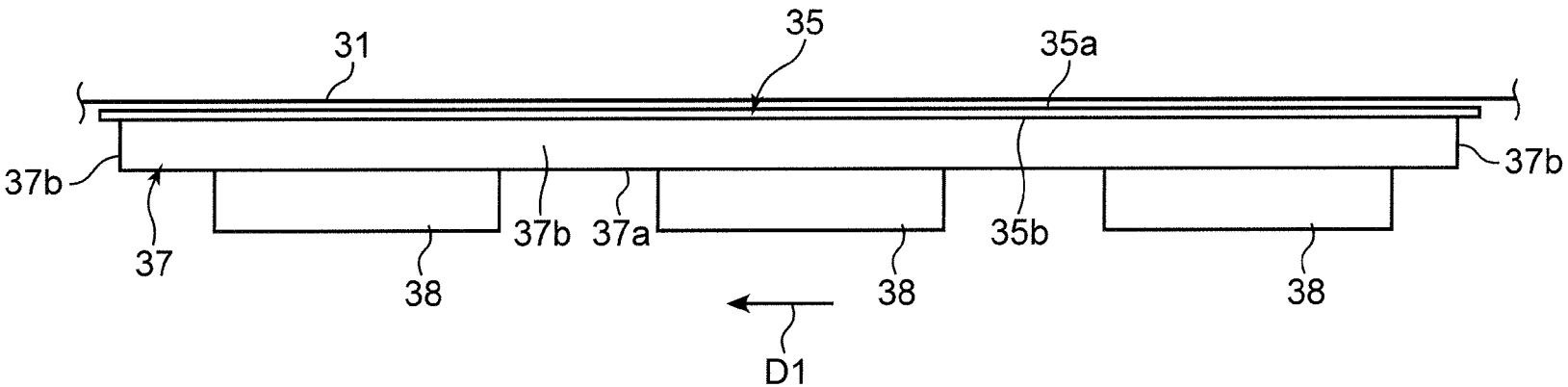
FIG. 5 is a side view showing the conveying belt, conveying platen, a fan case, and fans of the inkjet recording apparatus.
Figure 6:
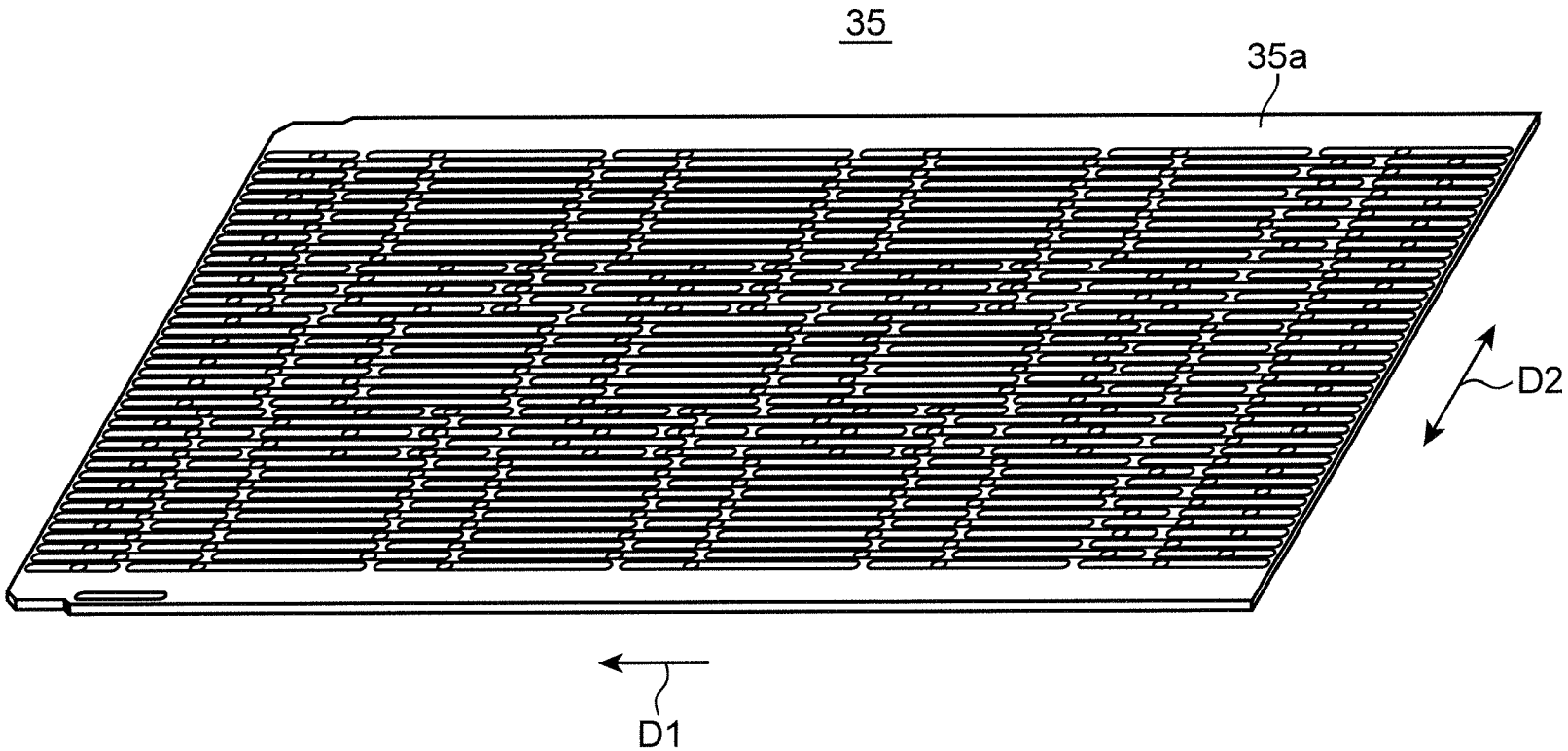
FIG. 6 is a perspective view showing the conveying platen of the inkjet recording apparatus.

As shown in FIGS. 4 to 6, the conveying platen 35 is a rectangular plate-like member. The conveying platen 35 is disposed along the conveying surface 47 of the conveying belt 31, under the conveying belt 31. The conveying platen 35 is disposed opposite to the recording part 20. An upper surface 35*a* of the conveying platen 35 faces a rear surface of the conveying belt 31 (a surface facing the conveying surface 47).

Figure 7:
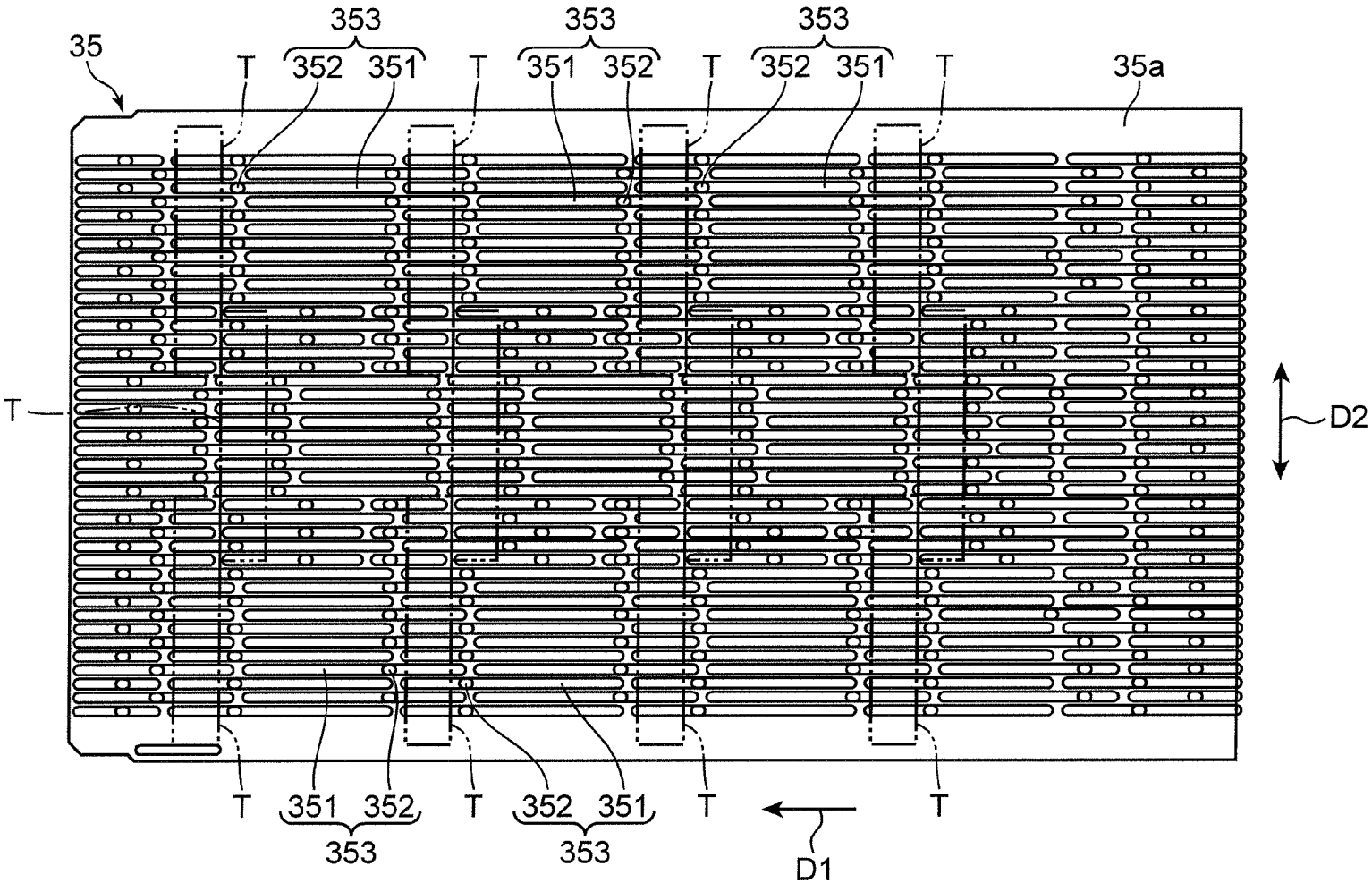
FIG. 7 is a plan view showing the conveying platen of the inkjet recording apparatus.

As shown in FIG. 7, a plurality of air circulation parts 353 are formed on substantially the entire area of the conveying platen 35. The plurality of air circulation parts 353 are arrayed not only along the direction D1 but also along the direction D2. Each of the air circulation parts 353 includes a long groove 351 and hole 352. The long groove 351 is formed on the upper surface 35*a* side of the conveying platen 35. The longitudinal direction of the long groove 351 extends along the direction D1. As shown in FIG. 4, the hole 352 passes through from a part of a bottom surface 351*a* of the long groove 351 to a lower surface 35*b* of the conveying platen 35. In this embodiment, each of the air circulation parts 353 has a single hole 352.

As shown in FIGS. 4 and 5, the fan case 37 has a rectangular bottom plate part 37*a* that is substantially the same size as the conveying platen 35, and side wall parts 37*b* standing upright from four circumferential rims of the bottom plate part 37*a*. An upper part of the fan case 37 is opened. An upper end of each of the side wall parts 37*b* is joined to the lower surface 35*b* of the conveying platen 35. The bottom plate part 37*a* has three opening parts 37*c* communicated with one of the three fans 38.

The three fans 38 are arrayed along the direction D1. Each of the fans 38 has an impeller (not shown), on the inside of the casing. When each fan 38 is driven to rotate the impeller, the pressure within the fan case 37 becomes negative. As a result, the air in the vicinity of the conveying surface 47 of the conveying belt 31 is suctioned to the fan 38 side through the through holes 31*a*, air circulation parts 353 and opening parts 37*c*. The obtained suction power adsorbs the sheet P, which is supplied to the conveying surface 47 of the conveying belt 31, to the conveying surface 47 of the conveying belt 31.

Figure 8:
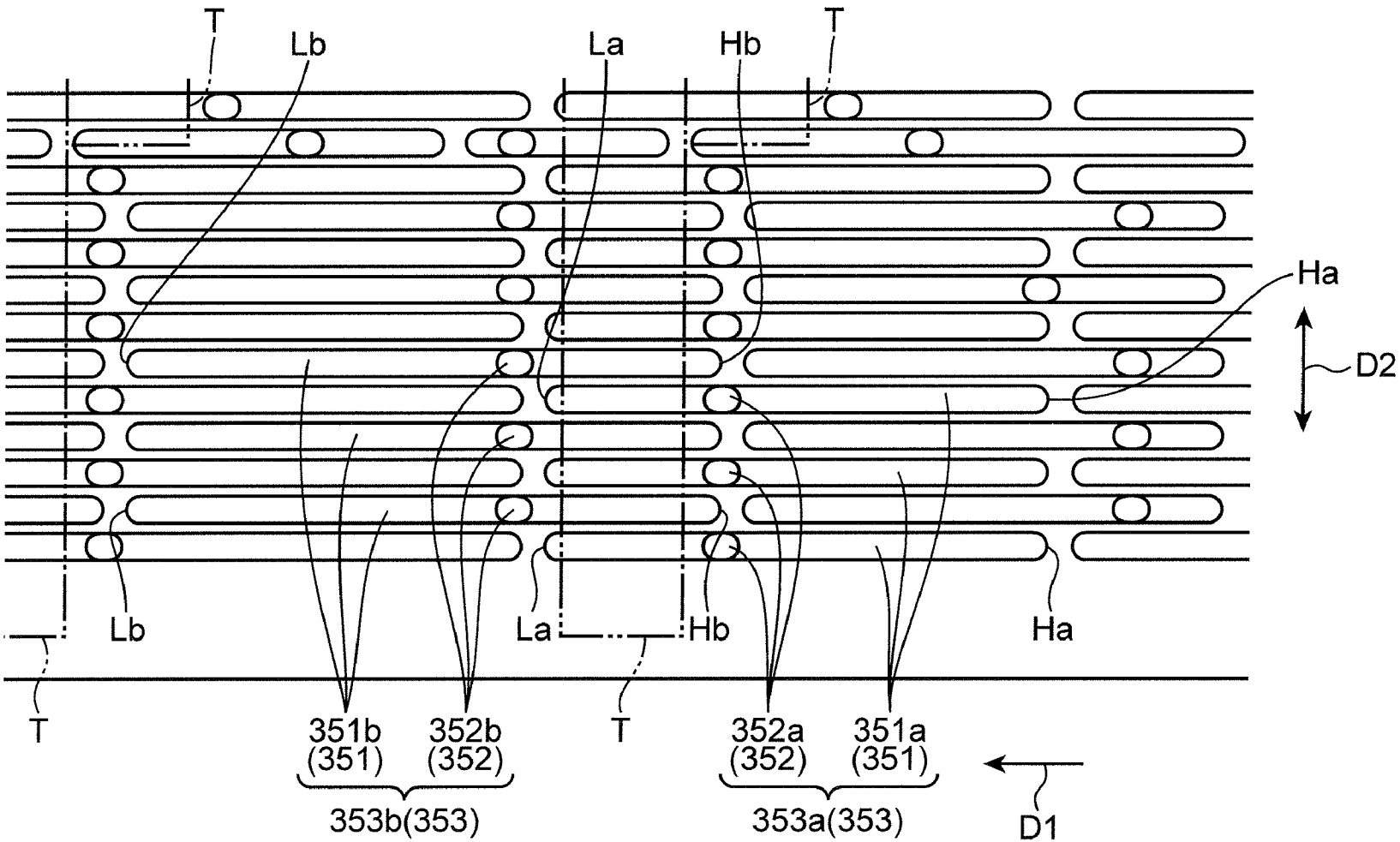
FIG. 8 is a plan view showing an enlargement of a part of FIG. 7.

FIG. 6 is a perspective view showing the conveying platen 35. FIG. 7 is a plan view showing the conveying platen 35. FIG. 8 is a plan view showing an enlargement of a part of FIG. 7. In FIGS. 7 and 8, opposed regions T facing the nozzle surfaces 22*a* are illustrated on the conveying platen 35 by two-dot chain lines. In a planar view of the inkjet heads 22 and conveying platen 35, each of the opposed regions T is located in the same position as the nozzle surfaces 22*a* corresponding to the inkjet heads 22.

In FIG. 8, of the plurality of air circulation parts 353, the one having a part of the long groove 351 located in the position of the opposed region T is denoted as "air circulation part 353*a*" or "air circulation part 353*b*." Of these air circulation parts, the one where the hole 352 is located on the upstream side away from the opposed region T (the side opposite to the direction D1) is denoted as "air circulation part 353*a*," and the one where the hole 352 is located on the downstream side away from the opposed region T (the direction D1 side) as "air circulation part 353*b*."

As shown in FIGS. 7 and 8, each of the opposed regions T is provided with a long groove 351*a* of each air circulation part 353*a*, and a long groove 351*b* of each air circulation part 353*b*. In other words, the long grooves 351*a* and long grooves 351*b* are disposed to cross the opposed region T from the upstream side to the downstream side. On the other hand, the hole 352 of each air circulation part 353*a* and the hole 352 of each air circulation part 353*b* are provided in regions other than the opposed regions T. Each of the holes 352 (352*a*, 352*b*) is provided in a position adjacent to the corresponding opposed region T.

The air circulation parts 353*a* and air circulation parts 353*b* are disposed alternately along the direction D2. The holes 352 (352*a*, 352*b*) are disposed in the positions on the upstream side of the opposed regions T and the positions on the downstream side of the same, alternately along the direction D2.

A downstream side end part La of each long groove 351*a* of the corresponding air circulation part 353*a* is provided in a position adjacent to the opposed region T at the downstream away from the opposed region T. An upstream side end part Hb of each long groove 351*b* of the corresponding air circulation part 353*b* is provided in a position adjacent to the opposed region T at the upstream away from the opposed region T. An upstream side end part Ha and the downstream side end part Lain the long groove 351*a* of the air circulation part 353*a* are provided in positions that do not face the upstream side end part Hb and a downstream side end part Lb of the long groove 351*b* of the air circulation part 353*b*, in the direction D2.

A summary of the embodiment described above is set forth as follows.

(1) The inkjet recording apparatus according to this embodiment includes a conveying belt, inkjet head, conveying platen, and negative pressure generating part. The conveying belt has a plurality of through-holes, and conveys a recording medium in a conveying direction with the recording medium placed on a front surface thereof. The inkjet head has a nozzle surface provided with a plurality of nozzles, and the nozzle surface is disposed opposite to the front surface of the conveying belt. The conveying platen is a plate-like member that is disposed opposite to a rear surface of the conveying belt. This conveying platen is provided with a plurality of air circulation parts, each of which includes a long groove, which is opened toward the conveying belt and formed in a longitudinal direction following the conveying direction, and a hole that penetrates in a thickness direction from a part of a bottom surface of the long groove. These air circulation parts are arrayed in the conveying direction and a width direction perpendicular to the conveying direction. The long groove is provided in an opposed region, which faces the nozzle surface, on the conveying plate, and the hole is provided in a region other than the opposed region.

In this configuration, the conveying platen has a structure in which the plurality of air circulation parts, each of which includes the long groove and the hole, are arrayed. Compared to a situation where a plurality of circular air circulation holes (through-holes) are provided as in the conveying platen of the conventional conveyance mechanism, the abovementioned structure can ensure a sufficient opening region where the long groove opens toward the conveying belt, even when the number of holes passing through the conveying platen is reduced significantly. Therefore, compared to the conveying platen of the conventional conveyance mechanism, the number of holes (through-holes) to be provided on the conveying platen can be reduced, whereby the fluctuation of the suction power caused by a change of the relative position between the conveying platen and the recording medium can be prevented.

In addition, in each air circulation part that includes the long groove and the hole, air suctioned from the entire long groove is concentrated on the hole. Thus, the force of the air tends to become strong near the hole. In this configuration, therefore, by providing the hole in the region other than the opposed region facing the nozzle surface, the ink is prevented from becoming viscous on the nozzle surface by preventing the increase of the force of the air flow in a space immediately below the nozzle surface. Meanwhile, by providing the long groove in the opposed region, the suction power to suction the recording medium in the opposed region can be ensured so that the recording medium can be prevented from floating in the space immediately below the nozzle surface.

(2) In the inkjet recording apparatus, in two adjacent air circulation parts in the width direction, each of which is provided with the long groove at the opposed region, it is preferred that the hole of one of the two adjacent air circulation parts be provided in a position on an upstream side away from the opposed region, and the hole of the other one of the two adjacent air circulation parts be provided in a position on a downstream side away from the opposed region.

In this configuration, the holes of the two two adjacent air circulation parts are provided on the upstream side and the downstream side in the opposed region, with the opposed region therebetween. Therefore, the flow of air that is suctioned through the air circulation parts can be prevented from leaning toward the upstream side or downstream side of the space immediately below the nozzle surface. Consequently, in the case where the recording medium enters immediately below the nozzle surface from the upstream side, and in the case where the recording medium escapes from immediately below the nozzle surface to the downstream side, the effect of preventing the recording medium from floating can be achieved.

(3) In the inkjet recording apparatus, it is preferred that each of the holes of the two adjacent air circulation parts be provided in a position adjacent to the opposed region.

In this configuration, because one of the holes of the two adjacent air circulation parts is provided on the upstream side away from the opposed region and adjacent to the opposed region, the front edge of the recording medium entering immediately below the nozzle surface can be suctioned by a sufficient suction power. Furthermore, because the hole of the other one of the air circulation parts is provided on the downstream side away from the opposed region and adjacent to the opposed region, the rear edge of the recording medium escaping from immediately below the nozzle surface to the downstream side can be suctioned by a sufficient suction power. Consequently, in the case where the recording medium enters immediately below the nozzle surface from the upstream side, and in the case where the recording medium escapes from immediately below the nozzle surface to the downstream side, the recording medium can be prevented from floating more effectively.

(4) In the inkjet recording apparatus, it is preferred that a downstream side end part (front end part) of the long groove of the one of the two adjacent air circulation parts be provided in the opposed region, or in a position adjacent to the opposed region on the downstream side away from the opposed region.

In this configuration, the hole of the one of the two adjacent air circulation parts is provided in a position on the upstream side away from the opposed region, and the downstream side end part of the long groove is provided in the opposed region or in a position adjacent to the opposed region on the downstream side away from the opposed region. Therefore, when the front edge of the recording medium enters immediately below the nozzle surface from the upstream side, most of the opening parts of the one of the two adjacent air circulation parts are covered by the recording medium. In other words, the negative pressure, which is applied to the front edge of the recording medium through the one of the two adjacent air circulation parts when the front edge of the recording medium enters immediately below the nozzle surface, is or close to the maximum negative pressure. Accordingly, the front edge of the recording medium can be suctioned by a great suction power immediately below the nozzle surface. Therefore, when the recording medium enters immediately below the nozzle surface from the upstream side, the front edge of the recording medium can be prevented from floating more effectively.

(5) In the inkjet recording apparatus, it is preferred that an upstream side end part (rear end part) of the long groove of the other one of the two adjacent air circulation parts be provided in the opposed region, or in a position adjacent to the opposed region on the upstream side away from the opposed region.

In this configuration, in the other one of the two adjacent air circulation parts, the hole is provided in a position on the downstream side away from the opposed region, and the upstream side end part of the long groove is provided in the opposed region or in a position adjacent to the opposed region on the upstream side away from the opposed region. Therefore, the most of the opening parts of the other one of the two adjacent air circulation parts can be continuously covered by the recording medium until the rear edge of the recording medium escapes from immediately below the nozzle surface to the downstream side. In other words, the negative pressure, which is applied to the rear edge of the recording medium through the other one of the two adjacent air circulation parts, is kept at or close to the maximum negative pressure, until the rear edge of the recording medium escapes from immediately below the nozzle surface. Accordingly, the rear edge of the recording medium can be suctioned by a great suction power immediately below the nozzle surface. Therefore, when the recording medium escapes from immediately below the nozzle surface to the downstream side, the rear edge of the recording medium can be prevented from floating more effectively.

(6) In the inkjet recording apparatus, it is preferred that, in the two adjacent air circulation parts, the long groove of the one of the two adjacent air circulation parts and the long groove of the other one of the two adjacent air circulation parts be provided in positions where end parts of the long grooves do not face each other in the width direction.

In two air circulation parts that are adjacent to each other in the conveying direction, an discontinuous portion (incision) is formed between the end parts of the long grooves, where there is no groove. The recording medium cannot be suctioned in this discontinuous portion. Thus, according to this configuration, in the two adjacent air circulation parts that are adjacent to each other in the width direction, the end part of one of the long grooves and the end part of the other one of the long grooves, which are lined up in the width direction, are provided in the positions that do not face each other in the width direction. Consequently, because the discontinuous portion between the long grooves does not continue in the width direction, the decline of the suction power at the discontinuous portion between the long grooves can be prevented.

In the inkjet recording apparatus, the downstream side end part of the one of the two adjacent air circulation parts and the hole of the other one of the two adjacent air circulation parts are alternately disposed along the width direction on the downstream side of the opposed region. The upstream side end part of the other one of the two adjacent air circulation parts and the hole of the one of the two adjacent air circulation parts are alternately disposed along the width direction on the upstream side of the opposed region. In other words, since the holes are provided in the positions that are substantially adjacent to each other in the width direction with respect to the discontinuous portion between the long grooves, the decline of the suction power at the discontinuous portion between the long grooves can be prevented more effectively.

It should be noted that the present invention is not limited to the aforementioned embodiment, and can be changed variously or improved without departing from the scope thereof. For example, although the embodiment was described with an example of a four-color inkjet recording apparatus, the present invention can be applied to an inkjet recording apparatus that uses single color ink or ink of at least five colors.

The embodiment was described with an example in which one hole is formed in each air circulation part. However, two or more holes may be formed in one air circulation part. Specifically, for example, the long groove is disposed in the opposed region, and the holes are provided on bottom surface of the long groove on the upstream side and the bottom surface on the downstream side. In other words, these holes are provided in the region other than the opposed region, to sandwich the opposed region with the upstream side and the downstream side.

Furthermore, the embodiment was described with an example in which, in two adjacent air circulation parts in the width direction, the downstream side end part of the long groove of the one of the two adjacent air circulation parts is provided in the position adjacent to the opposed region on the downstream side away from the opposed region. However, the downstream side end part of the long groove may be provided within the opposed region.

The embodiment was described with an example in which, in two adjacent air circulation parts in the width direction, the upstream side end part of the long groove of the other one of the two adjacent air circulation parts is provided in the position adjacent to the opposed region on the upstream side away from the opposed region. However, the upstream side end part of the long groove may be provided within the opposed region.

In addition, the embodiment was described with an example in which, in the two adjacent circulation parts in the width direction, all of the air circulation parts satisfy the positional relationship where the end parts of one and the other long grooves of the two air circulation parts are provided in the positions that do not face each other in the width direction. However, not all air circulation parts need to satisfy such positional relationship, and therefore some air circulation parts may satisfy the positional relationship.

This application is based on Japanese Patent Application Serial No. 2009-268210 filed in Japan Patent Office on Nov. 26, 2009, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An inkjet recording apparatus, comprising:

a conveying belt that has opposite front and rear surfaces and a plurality of through-holes extending through the conveying belt from the front surface to the rear surface thereof, the conveying belt conveying a recording medium in a conveying direction with the recording medium placed on the front surface thereof;

an inkjet head that has a nozzle surface provided with a plurality of nozzles and disposed opposite to the front surface of the conveying belt;

a plate-like conveying platen disposed opposite to rear surface of the conveying belt and provided with a plurality of air circulation parts, each of which includes a long groove opened toward the conveying belt and formed in a longitudinal direction following the conveying direction, and a hole that penetrates in a thickness direction from a part of a bottom surface of the long groove, the air circulation parts being arrayed in the conveying direction and a width direction perpendicular to the conveying direction; and a negative pressure generating part that generates negative pressure to suction the recording medium through the air circulation parts of the conveying platen and the through-holes of the conveying belt and adsorb the recording medium onto the conveying belt, wherein the conveying platen has an opposed region that faces the nozzle surface, a part of the long groove is provided in the opposed region, and the hole is provided only in a region other than the opposed region.

2. The inkjet recording apparatus according to claim 1, wherein in two adjacent air circulation parts in the width direction, each of which is provided with the part of the long groove at the opposed region, the hole of one of the two adjacent air circulation parts is provided in a position on an upstream side away from the opposed region, and the hole of the other one of the two adjacent air circulation parts is provided in a position on a downstream side away from the opposed region.

3. The inkjet recording apparatus according to claim 2, wherein each of the holes of the two adjacent air circulation parts is provided in a position adjacent to the opposed region.

4. The inkjet recording apparatus according to claim 2, wherein a downstream side end part of the long groove of the one of the two adjacent air circulation parts is provided in the opposed region, or in a position adjacent to the opposed region on the downstream side away from the opposed region.

5. The inkjet recording apparatus according to claim 2, wherein an upstream side end part of the long groove of the other one of the two adjacent air circulation parts is provided in the opposed region, or in a position adjacent to the opposed region on the upstream side away from the opposed region.

6. The inkjet recording apparatus according to claim 2, wherein in the two adjacent air circulation parts, the long groove of the one of the two adjacent air circulation parts and the long groove of the other one of the two adjacent air circulation parts are provided in positions where end parts of the long grooves do not face each other in the width direction.

7. The inkjet recording apparatus according to claim 1, wherein the hole is located at a position other than a central position of the long groove in the longitudinal direction such that the hole is positioned in the region other than the opposed region.

8. The inkjet recording apparatus according to claim 1, wherein the air circulation parts include a first long groove and a second long groove having a length in the longitudinal direction different from a length of the first long groove in the longitudinal direction.

9. The inkjet recording apparatus according to claim 1, wherein the air circulation parts are disposed on an area of the conveying platen to communicate with the through-holes of the conveying belt.

10. An inkjet recording apparatus comprising:

a conveying belt that has opposite front and rear surfaces and a plurality of through-holes extending through the conveying belt from the front surface to the rear surface thereof, the conveying belt conveying a recording medium in a conveying direction with the recording medium placed on the front surface thereof;

an inkjet head that has a nozzle surface provided with a plurality of nozzles and disposed opposite to the front surface of the conveying belt;

a plate-like conveying platen disposed opposite to the rear surface of the conveying belt and provided with a plurality of air circulation parts, each of which includes a long groove opened toward the conveying belt and formed in a longitudinal direction following the conveying direction, and a hole that penetrates in a thickness direction from a part of a bottom surface of the long groove, the air circulation parts being arrayed in the conveying direction and in width direction perpendicular to the conveying direction; and a negative pressure generating part that generates negative pressure to suction the recording medium through the air circulation parts of the conveying platen and the through-holes of the conveying belt and adsorb the recording medium onto the conveying belt, wherein the conveying platen has an opposed region that faces the nozzle surface, a part of the long groove is provided in the opposed region, the hole is located at a position other than a central position of the long groove in the longitudinal direction such that the hole is positioned in a region other than the opposed region.

11. The inkjet recording apparatus according to claim 10, wherein the air circulation parts include a first long groove, and a second long groove having a length in the longitudinal direction different from a length of the first long groove in the longitudinal direction.

12. The inkjet recording apparatus according to claim 10, wherein the air circulation parts are disposed on an area of the conveying platen and to communicate with the through holes of the conveying belt.

13. An inkjet recording apparatus, comprising:

a conveying belt that has opposite front and rear surfaces and a plurality of through-holes extending through the conveying belt from the front surface to the rear surface thereof, the conveying belt conveying a recording medium in a conveying direction with the recording medium placed on the front surface thereof;

an inkjet head that has a nozzle surface provided with a plurality of nozzles and disposed opposite to the front surface of the conveying belt;

a plate-like conveying platen disposed opposite to the rear surface of the conveying belt and provided with a plurality of air circulation parts, each of which includes a long groove opened toward the conveying belt and formed in a longitudinal direction following the conveying direction, and a hole that penetrates in a thickness direction from a part of a bottom surface of the long groove, the air circulation parts being arrayed in the conveying direction and a width direction perpendicular to the conveying direction; and a negative pressure generating part that generates negative pressure to suction the recording medium through the air circulation parts of the conveying platen and the through-holes of the conveying belt and adsorb the recording medium on to the conveying belt, wherein the conveying platen has an opposed region that faces the nozzle surface, a part of the long groove is provided in the opposed region, and the hole is provided in a region other than the opposed region, and the air circulation parts include a first long groove, and a second long groove having a length in the longitudinal direction different from a length of the first long groove in the longitudinal direction.

14. The inkjet recording apparatus according to claim 13, wherein the air circulation parts are disposed on an area of the conveying platen to communicate with the through-holes of the conveying belt.

* * * * *